US007374466B2

(12) United States Patent
Onuma et al.

(10) Patent No.: US 7,374,466 B2
(45) Date of Patent: May 20, 2008

(54) METHOD OF CONNECTING WIRE AND TERMINAL FITTING

(75) Inventors: Masanori Onuma, Haibara-gun (JP); Kei Fujimoto, Haibara-gun (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/634,847

(22) Filed: Aug. 6, 2003

(65) Prior Publication Data

US 2004/0029454 A1 Feb. 12, 2004

(30) Foreign Application Priority Data

Aug. 7, 2002 (JP) ..... 2002-229656

(51) Int. Cl.
*H01R 4/02* (2006.01)

(52) U.S. Cl. ..... 439/874; 439/879

(58) Field of Classification Search ..... 439/847, 439/879, 874, 877; 174/84 C
See application file for complete search history.

(56) References Cited

U.S. PATENT DOCUMENTS

| | | | | |
|---|---|---|---|---|
| 3,255,430 | A * | 6/1966 | Phillips | 439/786 |
| 3,656,092 | A * | 4/1972 | Swengel et al. | 439/730 |
| 4,031,614 | A * | 6/1977 | Gipe | 29/879 |
| 4,596,440 | A * | 6/1986 | Quam | 439/827 |
| 4,902,253 | A * | 2/1990 | Schacht | 439/877 |
| 4,998,344 | A * | 3/1991 | Hsieh | 29/894.362 |
| 5,499,448 | A * | 3/1996 | Tournier et al. | 29/863 |
| 5,624,287 | A * | 4/1997 | Newman et al. | 439/801 |
| 5,772,454 | A * | 6/1998 | Long, Jr. | 439/83 |
| 6,059,617 | A * | 5/2000 | Shinchi | 439/874 |
| 6,334,798 | B1 * | 1/2002 | Ushijima et al. | 439/879 |
| 6,538,203 | B1 * | 3/2003 | Nolle et al. | 174/84 R |
| 6,666,732 | B1 * | 12/2003 | Endacott | 439/874 |

FOREIGN PATENT DOCUMENTS

| | | |
|---|---|---|
| DE | 199 08 031 A1 | 9/2000 |
| FR | 2 501 923 A1 | 9/1982 |
| JP | 4-24267 U | 2/1992 |
| JP | 05-190247 A | 7/1993 |
| JP | 05-343150 A | 12/1993 |
| JP | 07-161392 A | 6/1995 |
| JP | 09-082447 A | 3/1997 |
| JP | 2002-158044 A | 5/2002 |

* cited by examiner

*Primary Examiner*—Thanh-Tam Le
(74) *Attorney, Agent, or Firm*—Sughrue Mion, PLLC

(57) ABSTRACT

A method of connecting a terminal fitting and an electric wire, includes the steps of: providing a terminal fitting; providing an electric wire in which a core wire is covered with an insulating sheath; providing a conductive connecting member formed with an insertion hole; inserting the electric wire into the insertion hole of the connecting member; compressing the connecting member radially inwardly so as to caulk an inserted portion of the electric wire uniformly over a whole periphery thereof; and welding the connecting member and the terminal fitting by applying ultrasonic wave.

7 Claims, 4 Drawing Sheets

METHOD OF CONNECTING WIRE AND TERMINAL FITTING

BACKGROUND OF THE INVENTION

This invention relates to a wire-terminal connecting method in which a wire for feeding a power source current or a signal current to an on-vehicle part is connected to a terminal by ultrasonic welding.

One known related wire-terminal connecting method is disclosed in JP-A-54-43588.

As shown in FIG. 7, this related wire-terminal connecting method is directed to the method of an invention in which a distal end portion 51*a* of a wire 51 is beforehand fixed into a semi-circular shape, and thereafter this fixed distal end portion 51*a*, together with a flat-type aluminum wire 55 (serving as a connecting wire), is held between a tip 59 and an anvil 60 of an ultrasonic welding machine 56, and an interface 65 (FIG. 8) of joining between the wire 51 and the flat-type aluminum wire 55 is heated and melted by vibrational energy, thereby effecting the welding.

The distal end portion 51*a* of the wire 51 is fixed into the predetermined shape by the use of a resistance welding machine (not shown) including an upper electrode with a semi-circular fitting groove and a lower electrode disposed in opposed relation to this upper electrode.

In FIG. 7, reference numeral 55 denotes the flat-type aluminum wire to be connected to the wire 51, reference numeral 56 denotes the ultrasonic welding machine, reference numeral 57 denotes an ultrasonic wave-generating source, reference numeral 58 denotes a horn for transmitting ultrasonic waves from the ultrasonic wave-generating source 57, and reference numeral 59 denotes the tip provided at a distal end of the horn 58.

The tip 59 has a semicircular groove 59*a* extending in a direction perpendicular to a direction a of vibration of ultrasonic waves. Reference numeral 60 denotes the anvil provided in opposed relation to the tip 59. An upper surface of the anvil 60 is formed into a flat surface.

The flat-type aluminum wire 55 and the wire 51 are placed on the anvil 60 of the ultrasonic welding machine 56 in such a manner that the wire 51 is superposed on the aluminum wire 55, and then the tip 59 is moved toward the anvil 60, so that the distal end portion 51*a* of the wire 51 fits into the groove 59*a* in the tip 59. As a result, the wire 51 is pressed from the upper side, and is held in place since the depth of the groove 59*a* in the tip 59 is slightly smaller than the height of the semi-circular distal end portion 51*a* of the wire 51.

Then, when ultrasonic waves are applied from the ultrasonic wave-generating source 57 via the horn 58 and the tip 59, the vibrational energy propagates to the interface 65 of joining between the wire 51 and the flat-type aluminum wire 55 while the wire 51 is kept in a restrained condition since the direction of extending of the groove 59*a* in the tip 59 is substantially perpendicular to the vibrating direction a. As a result, this joining interface portion 65 is heated and melted by frictional heat, thereby connecting the wire 51 and the flat-type aluminum wire 55 together.

However, the above related wire-terminal connecting method has the following problems to be solved.

Firstly, when the wire (workpiece) 51 is pressed by the tip 59 as shown in FIG. 8, stresses concentration a boundary portion 51*b* between each edge portion 59*b* of the tip 59 and the wire 51, and besides when the tip 59 is ultrasonically vibrated, the edge portion 59*b* of the tip 59 and the wire 51 rub against each other at each boundary portion 51*b*, thus inviting a problem that wire elements 51*c* undergo damage such as cutting.

Secondly, the larger the pressing force, applied by the tip 59, is, and the higher the ultrasonic vibration frequency is, the shorter the time of heating and melting of the joining interface portion 65 is, and on the other hand there is encountered a problem that the plurality of wire elements 51*c* are more liable to become loose, and also are more liable to undergo damage such as cutting. Therefore, it has been desired to provide an ultrasonic connecting method in which even when the ultrasonic vibration frequency is high, the wire elements 51*c* will not undergo damage such as cutting, and the operation for connecting the wire 51 and the flat-type aluminum wire 55 together can be effected easily.

And besides, when a conductor portion of a thick wire (connected to a battery so as to supply a source current) or a conductor portion of a thin wire (connected to an on-vehicle part so as to feed a signal current) is kept in an exposed condition, waterdrops, dust and so on deposit on the conductor portion (conducting portion), which invites a problem that the performance of contact between the conductor portion and the terminal is lowered.

SUMMARY OF THE INVENTION

It is therefore an object of the present invention to provide a method of connecting a wire and a terminal fitting, in which wire elements are prevented from being cut and from becoming loose during ultrasonic welding, and at the same time a water stop treatment of a wire is effected.

In order to achieve the above object, according to the present invention, there is provided a method of connecting a terminal fitting and an electric wire, comprising the steps of:

- providing a terminal fitting;
- providing an electric wire;
- providing a conductive connecting member formed with an insertion hole;
- inserting at least a part of the core wire of the electric wire into the insertion hole of the connecting member;
- compressing the connecting member radially inwardly so as to caulk an inserted portion of the electric wire uniformly over a whole periphery thereof; and
- welding the connecting member and the terminal fitting by applying ultrasonic wave.

In the above method, the conductor portion is inserted into the insertion hole in the connecting member, and the outer periphery of the connecting member is compressed and shaped over the entire periphery thereof, so that the connecting member is reduced in diameter, and the connecting member is held in intimate contact with the conductor portion. Then, the connecting member and the terminal fitting are located between a tip and an anvil of an ultrasonic welding machine in such a manner that the connecting member and the terminal fitting are superposed together, and the tip is moved toward the anvil to press the connecting member and the terminal fitting, and in this condition vibrational energy is applied to the tip via a vibrator and a horn, so that slip at the interface of joining between the connecting member and the terminal fitting and the heating due to internal friction are effected at the same time, and the diffusion of atoms is effected while the interface portion melts to a certain degree, and as a result the wire and the terminal are welded together through the connecting member. Thus, the conductor portion, consisting of the plurality of wire elements, is not pressed directly by the tip, and therefore the plurality of the wire elements will not become loose, and stresses will not concentrate on the conductor portion, so that the wire elements are prevented from undergoing damage such as cutting.

Preferably, the connecting member is compressed and shaped by rotary swaging.

In the above method, a plurality of radially-arranged dies of a rotary swaging apparatus cooperate respectively with buckers (hammers) to move radially, thereby periodically applying blows to the outer peripheral surface of the connecting member, so that the outer periphery of the connecting member is compressed and shaped with uniform stresses uniformly over the entire periphery thereof, and therefore the conductor portion of the wire is held in intimate contact with the inner peripheral surface of the insertion hole in the connecting member. Also, the area of contact between the conductor portion and the connecting member increases, so that the fixing force increases, and besides the reliability of the electrical contact is enhanced.

Preferably, the connecting member includes a first hole portion and a second hole portion which is larger than the first hole in diameter. The core wire is inserted in the first hole portion and the insulating sheath is inserted in the second hole portion, and the first hole portion and the second hole portion are disposed coaxially with each other. The electric wire has a core wire covered with an insulating sheath. The connecting member is compressed so that the insulating sheath is held in intimate contact with the second hole portion.

In the above method, the insulating sheath portion of the wire is held in intimate contact with the inner peripheral surface of the second hole portion of the connecting member, so that a gap between the wire and the connecting member is closed, thereby preventing waterdrops, dust and so on from intruding into the interior of the connecting member. Also, the reliability of the electrical connection is maintained.

Preferably, the terminal fitting is provided with a clamping portion. The connecting method further comprises the step of press-clamping the terminal by the clamping portion.

In the above method, the connecting member and the terminal fitting are connected together by press-fastening the press-clamping piece portion provided at the terminal fitting, and therefore the terminal fitting and the connecting member are connected together by both of the fixing force obtained by the welding and the press-clamping force obtained by the press-fastening operation. Also, the terminal fitting is positively prevented from being disengaged from the connecting member, so that the reliability of the electrical connection is enhanced.

In the above method, the connecting member includes the first diameter portion and the second portion which are disposed coaxially with each other, and the first diameter portion and the second diameter portion are simultaneously compressed and shaped by the rotary swaging apparatus.

In the above method, the first portion and the second portion of the connecting member are simultaneously compressed and shaped by the rotary swaging apparatus, and therefore the smaller-diameter portion and larger-diameter portion do not need to be compressed and shaped separately from each other, so that the efficiency of the shaping operation is enhanced.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

A preferred embodiment of the present invention will now be described in detail with reference to the drawings.

FIGS. 1 to 6 show one preferred embodiment of a wire-terminal connecting method of the invention.

Figure 1:
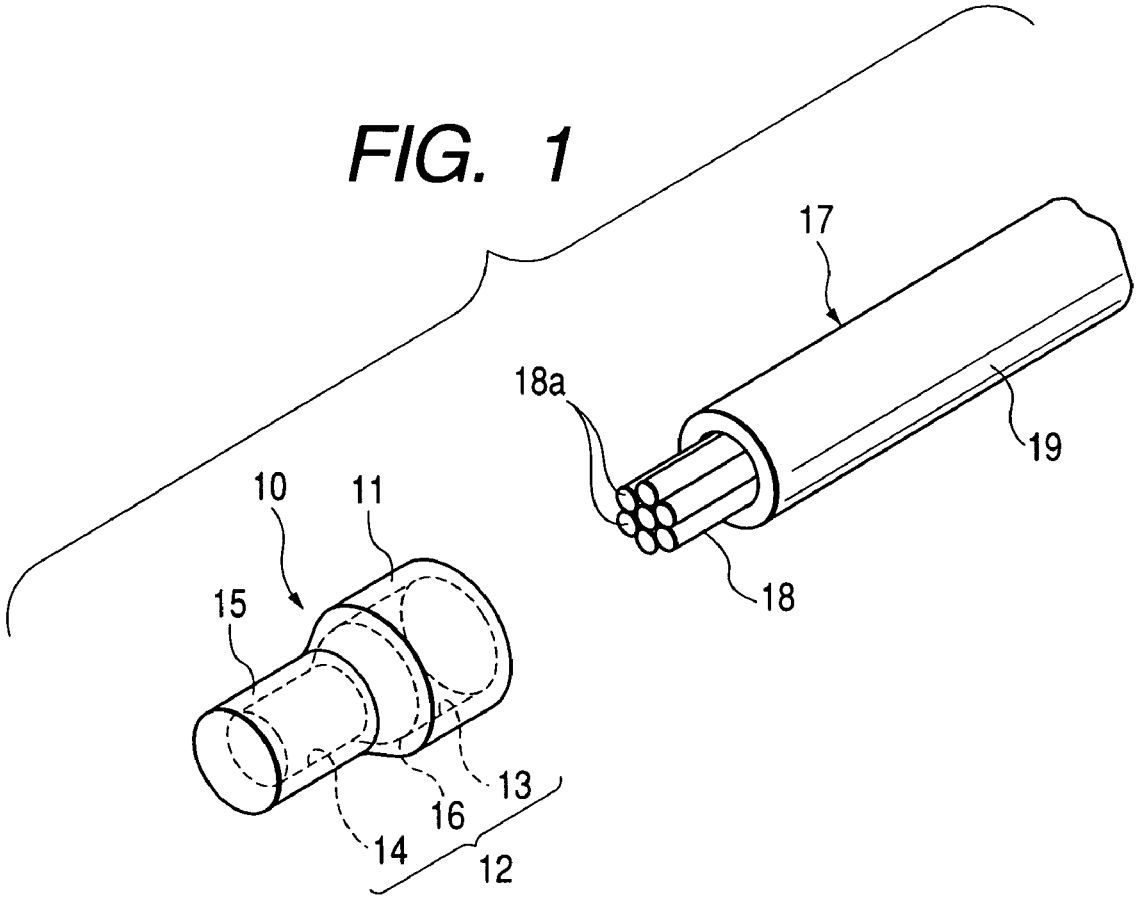
FIG. 1 is an exploded, perspective view showing one preferred embodiment of a wire-terminal connecting method of the present invention.

In FIG. 1, there are shown a connecting cap (connecting member) 10 made of an electrically-conductive material such as a copper alloy and an aluminum alloy, and an end portion of a wire 17 for insertion into an insertion hole 12 in the connecting cap 10.

The electrically-conductive connecting cap 10 is fitted on the end portion of the wire 17 (FIG. 2), and the outer periphery of the connecting cap 10 radially compressed by rotary swaging (described later), and the connecting cap 10 and an electrically-conductive terminal 40 are held between an anvil 31 and a tip 32 of an ultrasonic welding machine 30 (FIG. 6), and the connecting cap and the terminal are ultrasonically welded together.

The wire 17 includes a conductor portion 18 consisting of a plurality of wire elements 18*a*, and an insulating sheath portion 19 covering an outer periphery of the conductor portion 18. Although a material for forming the conductor portion 18 is not particularly limited, the conductor portion 18 is made, for example, of copper, a copper alloy or an aluminum alloy.

In the case where the conductor portion 18 is made of copper or a copper alloy, oxygen-free copper or tough pitch copper is used. In the case where the conductor portion 18 is made of an aluminum alloy, an aluminum alloy, containing substances such as Mg—Si, Mg and Zr is used. When it is desired to enhance electrical conductivity while decreasing contact resistance, there is used, in some cases, an aluminum alloy containing zinc.

The insulating sheath portion 19 is made of a soft synthetic resin such as a polyethylene resin, a polyvinyl chloride resin and a polypropylene resin. Depending on the kind of resin material, a resin (polyvinyl chloride) containing a plasticizer or a crosslinked resin (polyvinyl chloride, polyethylene) is used. For exposing the conductor portion 18, a slit is formed into the insulating sheath portion 19 by a cutter or the like, and the relevant portion of the insulating sheath portion 19 is removed by pulling it.

Figure 6:
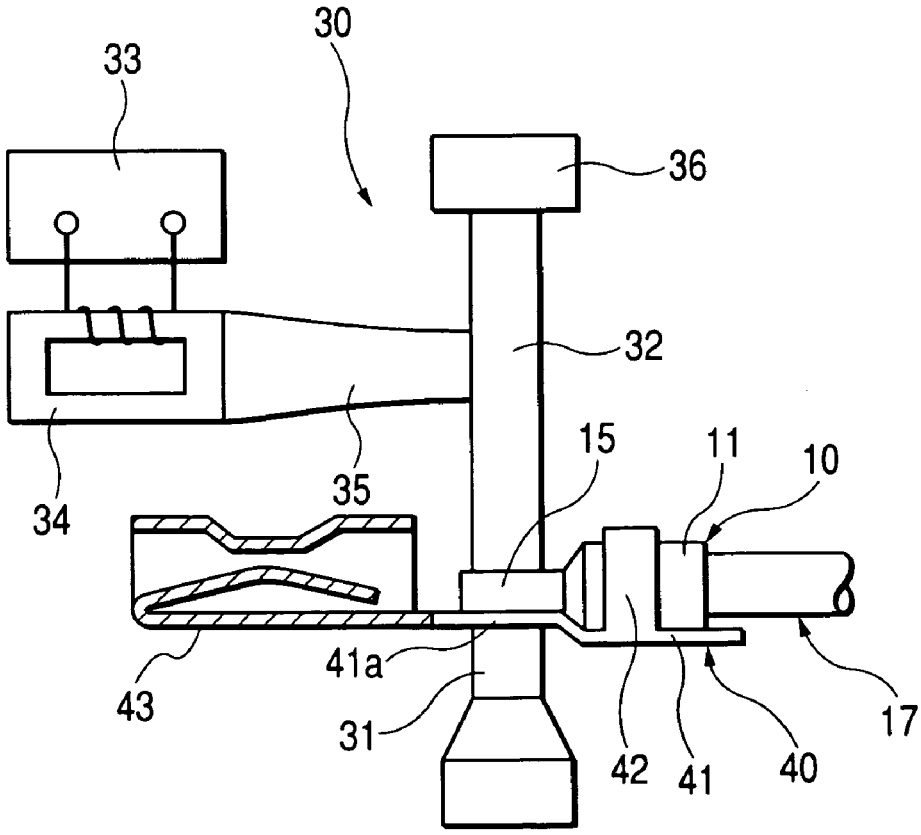
FIG. 6 is a view showing a basic construction of an ultrasonic welding machine used for connecting the connecting cap and a terminal together.
Figure 7:
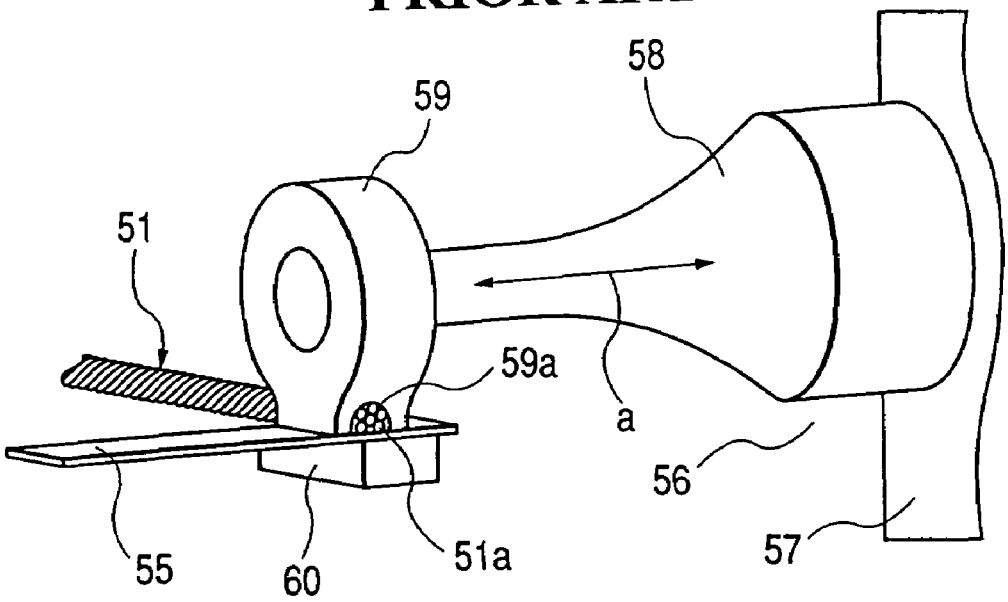
FIG. 7 PRIOR ART
FIG. 7 is a perspective view showing a related method of connecting a wire and a terminal together.
Figure 8:
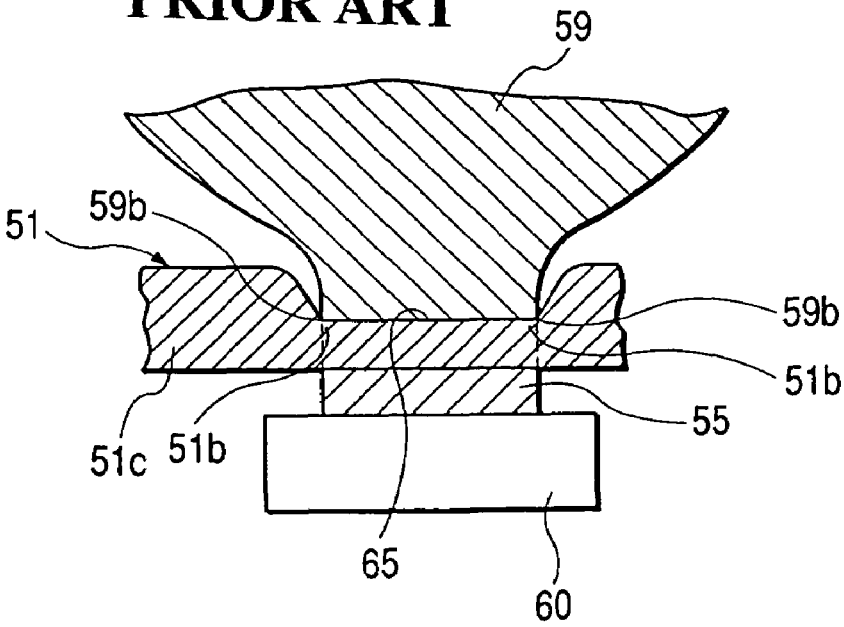
FIG. 8 PRIOR ART
FIG. 8 is a fragmentary cross-sectional view showing a condition in which the wire and the terminal, shown in FIG. 7, are ultrasonically welded together.

The terminal 40 shown in FIG. 6 is a female terminal of an integral construction which is formed by blanking a piece from an electrically-conductive base sheet of metal (such as copper, a copper alloy or an aluminum alloy) and by bending this piece. The female terminal has a box-like electrical contact portion 43 formed at one end portion thereof, and is adapted to be electrically connected to a tab-like electrical contact portion of a male terminal provided as a mating terminal (not shown). The terminal 40 is not limited to such female terminal, but may be a male terminal, an LA terminal or others, and terminals having various electrical contact portions can be used.

A wire connection portion 41, having a pair of press-clamping piece portions 42 (only one of which is shown), is formed at the other end of the terminal 40, and this wire connection portion 41 is adapted to be connected to the connecting cap 10. The pair of press-clamping piece portions 42 are pressed inwardly to be press-fastened and connected to a larger-diameter portion 11 of the connecting cap 10, and a body portion 41*a* of the wire connection portion 41 is connected to a smaller-diameter portion 15 of the connecting cap 10 by ultrasonic welding as shown in FIG. 6. Therefore, the terminal 40 and the connecting cap 10 are positively connected together by both of a fixing force obtained by the welding and a press-clamping force obtained by the press-fastening operation.

Referring again to FIG. 1, the connecting cap 10 has a stepped cylindrical shape, and includes the smaller-diameter portion 15 and the larger-diameter portion 11 which are coaxial with each other. The insertion hole 12, having a smaller hole portion 14 and a larger hole portion 13, is formed in the connecting cap 10. The smaller hole portion 14 of a circular cross-section for the insertion of the conductor portion 18 of the wire 17 thereinto is formed in the smaller-diameter portion 15, and the larger hole portion 13 of a circular cross-section for the insertion of the insulating sheath portion 19 of the wire 17 thereinto is formed in the larger-diameter portion 11. The smaller hole portion 14 is in the form of a blind hole so that the distal end of the conductor portion 18, inserted in the smaller hole portion 14, will not be exposed to the exterior.

The insertion hole 12 is formed by a boring process using a solid drill made of cemented carbide. Since the smaller hole portion 14 and the larger hole portion 13 are different in diameter from each other, the boring operation is effected using two drills (that is, a drill of a smaller diameter and a drill of a larger diameter). A distal end of the solid drill has a point angle of about 120 degrees, and therefore an inner end surface of the smaller hole portion 14 is formed into a conical tapering shape.

The shape of the distal end of the solid drill is reflected to a step portion 16 interconnecting the smaller hole portion 14 and the larger hole portion 13, and therefore this step portion 16 is formed into an annular tapering shape. The step portion 16 can be formed into a surface disposed perpendicular to the axis of the connecting cap, in which case the front end of the insulating sheath portion 19 abuts against this step portion 16, thereby limiting the length of insertion of the wire 17 in the longitudinal direction. In this case, the step portion 16 is cut into a surface disposed perpendicular to the axis of the connecting cap, using a boring tool having a tool angle of 90 degrees.

The inner diameter of the smaller hole portion 14 is generally equal to or slightly larger than the outer diameter of the conductor portion 18. If the inner diameter of the smaller hole portion 14 is smaller than the outer diameter of the conductor portion 18, the conductor portion 18 can not be smoothly inserted into the connecting cap 10.

The inner diameter of the larger hole portion 13 is generally equal to or slightly larger than the outer diameter of the insulating sheath portion 19. If the inner diameter of the large hole portion 13 is smaller than the outer diameter of the insulating sheath portion 19, the insulating sheath portion 19 can not be smoothly inserted into the connecting cap 10, and besides the air can not escape during the rotary swaging operation, so that the connecting cap 10 can not be compressed.

Even if a gap exists between the larger hole portion 13 and the insulating sheath portion 19, this gap is closed by the rotary swaging operation, and therefore waterdrops, dust and so on are prevented from intruding into the interior. The insulating sheath portion 19 is made of the soft synthetic resin, and therefore when the insulating sheath portion 19 is deformed, the gap is positively closed by an elastic restoring force of the insulating sheath portion 19.

The hole length (hole depth) of the smaller hole portion 14 is larger than the length of the exposed end portion of the conductor portion 18. If the hole length of the smaller hole portion 14 is generally equal to or slightly smaller than the exposed end portion of the conductor portion 18, the area of contact between the conductor portion 18 and the smaller hole portion 14 is small, so that the electrical connection performance is lowered. And besides, when the outer periphery of the smaller-diameter portion 15 is compressed by the rotary swaging operation (described later), the extension (elongation) of the conductor portion 18 is limited by the inner end surface of the smaller hole portion 14.

The hole length of the larger hole portion 13 is so determined that this larger hole portion 13 can intimately hold the insulating sheath portion 19 in closely-contacted relation thereto so as to prevent the rearward withdrawal of the wire 17. In this embodiment, the hole length of the larger hole portion 13 is generally equal to the hole length of the smaller hole portion 14.

The larger-diameter portion 11 and the smaller-diameter portion 15 are generally equal in wall thickness, and therefore the connecting cap 10 has a stepped cylindrical shape. Although the larger-diameter portion 11 is larger in outer diameter than the smaller-diameter portion 15, the larger-diameter portion 11 and the smaller-diameter portion 15 can be compressed at the same time by stepped inner surfaces 21*a* of dies 21 of a rotary swaging apparatus 20.

When the connecting cap 10 can be radially compressed into a uniform diameter over the entire length thereof and over the entire circumference, the connecting cap 10 can have a uniform diameter over the entire length to have a cylindrical shape even if the peripheral wall of the connecting cap 10 is not uniform over the entire length, and therefore is uneven. In this embodiment, the connecting cap 10 is formed into the stepped cylindrical shape, and by doing so, the smaller-diameter portion 15 and the larger-diameter portion 11 are generally equal in wall thickness to each other, and the compressive shaping can be effected easily, so that the conductor portion 18 and the insulating sheath portion 19 can be held in intimate contact respectively with the inner peripheral surfaces of the smaller hole portion 14 and larger hole portion 13, with no gap formed therebetween.

Figure 2:
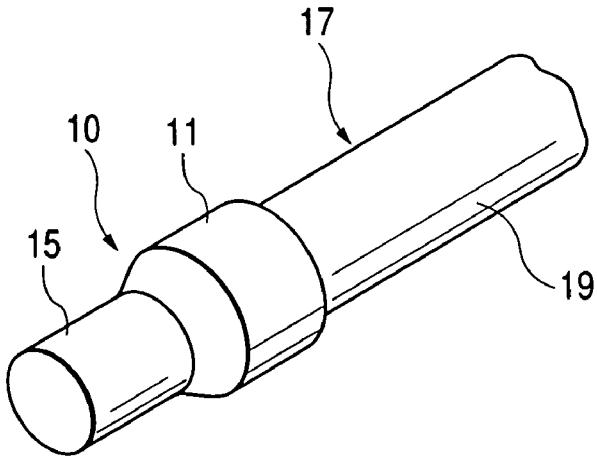
FIG. 2 is a perspective view showing a condition in which a connecting cap is fitted on an end portion of a wire in the wire-terminal connecting method of FIG. 1.
Figure 3:
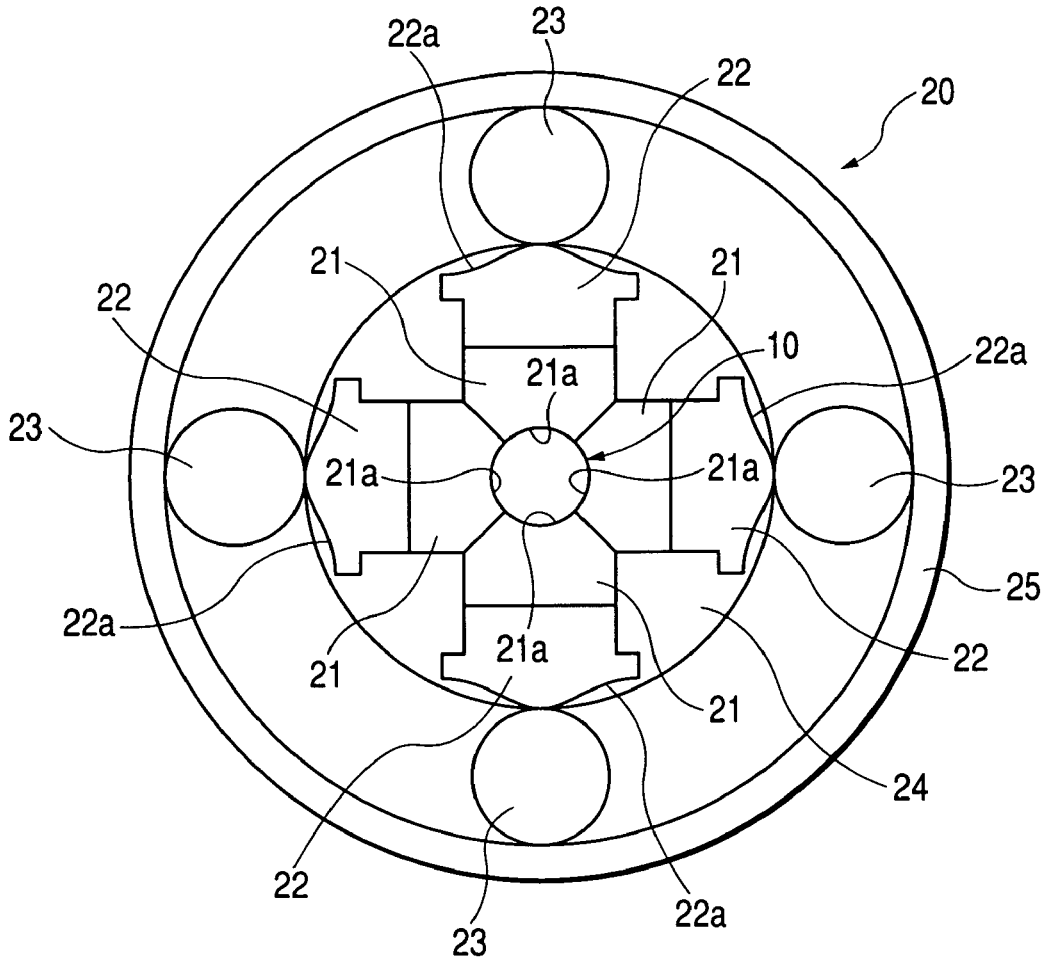
FIG. 3 is a front-elevational view of a rotary swaging apparatus for compressing and shaping the outer periphery of the connecting cap.

FIG. 2 shows a condition in which the connecting cap 10 is fitted on the end portion of the wire 17. The conductor portion 18 of the wire 17 is inserted in the smaller hole portion 14, while the insulating sheath portion 19 of the wire 17 is inserted in the larger hole portion 13. In this condition, the wire 17 is set in the rotary swaging apparatus 20 as shown in FIG. 3, and the outer periphery of the connecting cap 10 is compressed and shaped uniformly over the entire circumference thereof. Any other suitable processing method than the rotary swaging method can be used in so far as it can compress the outer periphery of the connecting cap 10 uniformly over the entire circumference thereof.

Next, the rotary swaging (rotary forging) will be described in detail with reference to FIG. 3. The rotary swaging is a kind of forging in which while rotating one of dies and rollers, hammer-like blows are repeatedly applied to a round bar or a pipe, thereby compressing this workpiece into a predetermined shape.

The rotary swaging apparatus 20, shown in FIG. 3, is a spindle drive-type apparatus in which dies 21 and buckers 22 are revolved by rotating a spindle 24. There is known another drive method in which rollers are rolled while dies and buckers are not rotated by keeping a spindle stationary.

The spindle drive-type has advantages that the whole of the apparatus can be formed into a compact design since the number of component parts is small (a flywheel and pulleys are not needed), and that a workpiece of a small diameter can be processed with high precision. The roller-rolling type is used when a workpiece is formed into other shape (such as a square cross-sectional shape) than a circular shape. In this embodiment, the spindle drive-type is adopted.

Within the spindle 24 of the spindle drive-type rotary swaging apparatus 20, the dies 21 and the buckers 22 are movably supported in such a manner that each die abuts against the corresponding bucker. In this embodiment, the two pairs of opposed dies 21 are arranged radially. The connecting cap (workpiece) 10 is located at the center of the spindle 24 in such a manner that this connecting cap 10 is gripped by inner surfaces 21*a* of the dies 21. By thus locating the connecting cap 10 at the axis of rotation of the spindle 24, blows can be applied to the outer peripheral surface of the connecting cap 10 uniformly over the entire circumference thereof.

The four dies 21 are arranged circumferentially at equal intervals. The number of the dies 21 is not limited to 4, but may be 2 or 8. By thus arranging the dies 21 at equal intervals, the outer periphery of the connecting cap 10 can be compressed uniformly.

The inner surface 21*a* of each die 21 is formed into a stepped shape, and the radially-arranged dies 21 press the smaller-diameter portion. 15 and larger-diameter portion 11 of the connecting cap 10 at the same time. With this stepped shape of the dies, the smaller-diameter portion 15 and larger-diameter portion 11 of the connecting cap 10 can be compressed at the same time in one step of the process, and the shaping operation can be effected easily and efficiently.

In the case where the connecting cap 10 has a cylindrical shape, the inner surface 21*a* of each die 21 does not need to be stepped, and also in the case where the smaller-diameter portion 15 and larger-diameter portion 11 of the connecting cap 10 of a stepped cylindrical shape are subjected to rotary swaging independently of each other, the inner surface 21*a* of each die 21 does not need to be stepped.

The bucker 22, provided at the rear side of (that is, radially outwardly of) the die 21, is separate from the die 21, but the bucker 22 revolves together with the die 21, and also can move in a radial direction (toward the center). This revolution is effected by rotating the spindle 24 by a motor (not shown). The movement in the radial direction is effected by the rotational contact between the bucker 22 and the roller 23.

An outer surface of the bucker 22 defines a cam surface 22*a*. This cam surface 22*a* is not formed into a constant radius of curvature, but a widthwise-central portion of the cam surface projects radially outwardly. Therefore, when the bucker 22 is brought into rotational contact with the roller 23, the bucker 22 is pushed radially inwardly by the roller 23 by an amount corresponding to the amount of projecting of the central portion of the bucker, so that the die 21 moves radially inwardly.

The spherical rollers 23 are provided between the outer peripheral surface of the spindle 24 and an outer ring 25, and are arranged at equal intervals, and are supported for rotation about their respective axes. The number of the rollers 23 is 4 (which is equal to the number of the dies 21), but may be 8. The larger the number of the rollers 23 is, the larger the number of the blows per rotation of the spindle is, and the processing rate of the connecting cap 10 is enhanced. High-carbon/low chromium bearing steel, having excellent wear resistance and impact resistance, is suitably used as a material for forming the rollers 23.

The pressing condition and the non-pressing condition which are determined by the positions of the dies 21 and buckers 22 relative to the rollers 23 will be described. When the spindle 24 is rotated, the dies 21 and the buckers 22 revolve, and also the rollers 23 rotate about their respective axes. Each bucker 22 is located radially outwardly of the associated die 21, and therefore the revolving bucker 22 is brought into contact with the roller 23, and the cam surface 22*a* of the bucker 22 slides on the roller 23, so that the inner surface of the bucker 22 pushes the die 21 radially inwardly, and as a result the inner surface 21*a* of each die 21 strikes against the outer peripheral surface of the connecting cap 10, thereby effecting the forging operation When each bucker 22 is brought out of contact with the roller 23, the bucker 22 slightly projects radially outwardly under the influence of a centrifugal force, so that the die 21 moves apart from the connecting cap 10, and therefore the application of a blow by the die 21 is once stopped. Then, each bucker 22 is brought into contact with the roller 23, and the above operation is repeated.

Figure 4:
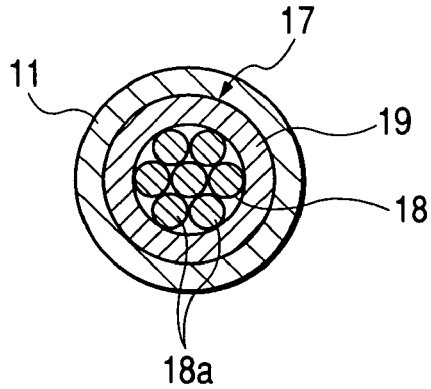
FIG. 4 is a cross-sectional view of a larger-diameter portion of the connecting cap compressed and shaped by rotary swaging.
Figure 5:
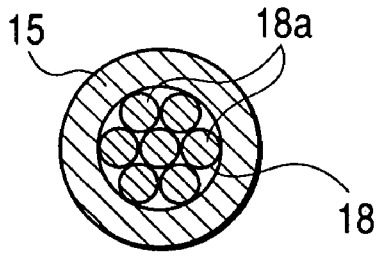
FIG. 5 is a cross-sectional view of a smaller-diameter portion of the connecting cap compressed and shaped by rotary swaging.

FIG. 4 shows a condition in which the larger-diameter portion 11 of the connecting cap 10 is compressed by rotary swaging, and FIG. 5 shows a condition in which the smaller-diameter portion 15 is compressed by rotary swaging. As shown in FIG. 4, the conductor portion 18 and the insulating sheath portion 19, disposed inside the larger-diameter portion 11, are radially compressed hard, and the wire elements 18*a* of the conductor portion 18 are deformed in a honeycomb-like manner, and are held in intimate contact with one another, and an elastic restoring force of the insulating sheath portion 19 acts on the inner peripheral surface of the larger hole portion 13. Like the larger-diameter portion 11, the smaller-diameter portion 15 is compressed radially, and the conductor portion 18 is held in intimate contact with the inner peripheral surface of the smaller hole portion 14 as shown in FIG. 15.

Next, an ultrasonic welding method will be described.

Ultrasonic welding is a welding method in which vibrational energy is applied to an interface of joining between two workpieces while the two workpieces are pressed against each other. When the vibrational energy is applied, slip at the joining interface and the heating due to internal friction are effected, and the diffusion of atoms is effected while the workpieces melt to a certain degree, so that the two workpieces are welded together at the joining interface. In the ultrasonic welding, heat-affected layers in the vicinity of the welded portion are narrow, and therefore the ultrasonic welding is used, for example, for welding thin parts such as an electronic part and for welding low-melting non-metal materials.

As shown in FIG. 6, the ultrasonic welding machine 30 includes an ultrasonic generator 33, a vibrator 34, a horn 35, the tip 32, the anvil 31 and a weight 36. These component parts will be described below.

The ordinary ultrasonic generator 33 can produce electric energy of about 100 W to about 10 kW. The vibrator 34 is a magnetostrictive vibrator of a ferromagnetic material placed in a magnetic field, and when the vibrator 34 receives the electric energy from the ultrasonic generator 33, it produces vibration energy. The horn 35 serves to transmit ultrasonic vibrations from the vibrator 34 to the tip. Although the horn 35 is disposed horizontally, its direction can be suitably changed, and for example, this horn can be disposed vertically.

The tip 32 and the anvil 31 are upper and lower tools, respectively, and hold the connecting cap 10 and the terminal 40 (which are the workpieces) therebetween in a manner to press the two workpieces. The weight 36 serves to press the tip 32. Instead of the weight 36, a hydraulic apparatus may be used as pressing means.

Referring to one example of processing conditions for the ultrasonic welding machine 30 of this construction, the ultrasonic output is about several Kw, and the ultrasonic frequency is 15 to 30 kHz, and the ultrasonic amplitude (the amplitude of the horn) is 40 to 50 μm, and the pressing force of the tip 32 is 300 N to 500 N.

In this embodiment, the connecting cap 10 is attached to the end portion of the wire 17 in such a manner that the conductor portion 18 and the insulating sheath portion 19 are inserted into the insertion hole 12 in the connecting cap 10, and the connecting cap 10 is compressed and shaped by rotary swaging, so that the connecting cap 10 and the terminal 40 are ultrasonically welded together in such a manner that the conductor portion 18 and the insulating sheath portion 19 are held in intimate contact with the inner peripheral surface of the insertion hole 12 in the connecting cap 10, with no gap formed therebetween. Therefore, the plurality of wire elements 18*a*, forming the conductor portion 18 of the wire 17, will not become loose, and stresses will not concentrate on the conductor portion 18, and the conductor portion 18 will not be rubbed, so that the wire elements 18 are prevented from undergoing damage such as cutting, and besides water, dust and so on are prevented from intruding into the interior of the connecting cap 10.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A method of connecting a terminal fitting and an elastic wire, comprising the steps of:

providing a terminal fitting;

providing an electric wire;

providing a conductive connecting member formed with an insertion hole, the connecting member which includes an outer peripheral portion having a continuous cylindrical shape;

inserting the electric wire into the insertion hole of the connecting member;

compressing the outer peripheral portion of the connecting member radially inwardly so as to caulk an inserted portion of the electric wire uniformly over a whole periphery thereof; and thereafter welding the connecting member and the terminal fitting by applying ultrasonic wave;

wherein the electric wire comprises wire elements;

wherein the wire elements comprise a covered portion which is covered by an insulating sheath and an exposed portion which is exposed;

wherein when the electric wire is inserted into the insertion hole of the connecting member, the connecting member covers a portion of the exposed portion and a portion of the covered portion;

wherein when the electric wire is inserted into the insertion hole of the connecting member, the connecting member covers all of the exposed portion of the wire elements; and wherein the connecting member includes an open end into which the electric wire is inserted and a closed end opposite the open end.

2. The method as set forth in claim 1, wherein the connecting member is compressed and shaped by rotary swaging.

3. The method as set forth in claim 1, wherein the connecting member includes a first hole portion and a second hole portion which is larger than the first hole in diameter;

wherein the electric wire has a core wire covered with an insulating sheath;

wherein the core wire is inserted in the first hole portion and the insulating sheath is inserted in the second hole portion, and the first hole portion and the second hole portion are disposed coaxially with each other; and wherein the connecting member is compressed so that the insulating sheath is held in intimate contact with the second hole portion.

4. The method as set forth in claim 1, wherein the terminal fitting is provided with a clamping portion; and further comprising the step of press-clamping the conductive connecting member by the clamping portion.

5. The method as set forth in claim 1, wherein the connecting member comprises a connecting cap having a large diameter portion and a small diameter portion.

6. The method as set forth in claim 1, wherein the inserting the electric wire into the insertion hole is performed after the providing the conductive connecting member formed with the insertion hole.

7. The method as set forth in claim 6, wherein the compressing the outer peripheral portion of the connecting member radially inwardly is performed after the inserting the electric wire into the insertion hole.

* * * * *